US010471586B2

(12) United States Patent
Wright

(10) Patent No.: US 10,471,586 B2
(45) Date of Patent: Nov. 12, 2019

(54) APPARATUS, METHOD, AND SYSTEM FOR HARDWARE MAPPING AND MANAGEMENT

(71) Applicant: Channing Dewitt Wright, Atlanta, GA (US)

(72) Inventor: Channing Dewitt Wright, Atlanta, GA (US)

( * ) Notice: Subject to any disclaimer, the term of this patent is extended or adjusted under 35 U.S.C. 154(b) by 0 days.

(21) Appl. No.: 15/943,260

(22) Filed: Apr. 2, 2018

(65) Prior Publication Data

US 2018/0290291 A1 Oct. 11, 2018

Related U.S. Application Data

(63) Continuation-in-part of application No. 15/193,029, filed on Jun. 25, 2016, now abandoned.

(51) Int. Cl.

| | |
|---|---|
| ***B25H 3/04*** | (2006.01) |
| ***A47F 7/00*** | (2006.01) |
| ***B25H 3/00*** | (2006.01) |
| ***B25H 7/02*** | (2006.01) |

(52) U.S. Cl.

CPC ..... *B25H 3/04* (2013.01); *A47F 7/0028* (2013.01); *B25H 3/003* (2013.01); *B25H 3/006* (2013.01); *B25H 7/02* (2013.01); *A45F 2200/0575* (2013.01)

(58) Field of Classification Search

CPC . B25H 7/02; B25H 3/003; B25H 3/04; B25H 3/06; B25H 3/006; A47F 7/0028

See application file for complete search history.

(56) References Cited

U.S. PATENT DOCUMENTS 811,414 A * 1/1906 Francis ..... B25H 3/003 206/379
2,728,145 A * 12/1955 Holladay ..... G01B 3/36 33/199 R (Continued)

FOREIGN PATENT DOCUMENTS

CA 2848739 A1 * 10/2015 ..... F16L 23/02
DE 3815772 A1 * 11/1989 ..... B23B 49/026

(Continued)

*Primary Examiner* — Stanton L Krycinski
(74) *Attorney, Agent, or Firm* — Bekiares Eliezer LLP

(57) ABSTRACT

An Apparatus, Method, and System for Hardware Mapping and Management is disclosed. Apparatus comprises a substrate housing hardware units associated with an object; one or more holes within the substrate for housing at least one hardware unit of the object are positioned based on a layout corresponding to the hardware units' assembly within the object. A method providing a plurality of substrates for housing hardware comprised of at least two components and at least two hardware units for each component, configuring a first plurality of holes within a first substrate of the plurality of substrate, wherein the first plurality of holes are laid out within the first substrate at locations relative the location of hardware units within a first component, and configuring a second plurality of holes within a second substrate of the plurality of substrate, wherein the second plurality of holes are laid out within the second substrate at locations relative the location of hardware units within a second component.

11 Claims, 6 Drawing Sheets

(56) References Cited

U.S. PATENT DOCUMENTS 2,830,380 A * 4/1958 Rumonoski ..... G01B 3/40 33/199 R
2,928,181 A * 3/1960 Siemantel ..... G01B 3/40 33/199 R
3,046,818 A * 7/1962 Saha ..... E04B 2/766 408/103
3,436,155 A * 4/1969 Perin, Jr. ..... B23B 49/026 356/138
3,727,771 A * 4/1973 Hoffman ..... B25H 3/003 206/379
3,827,820 A * 8/1974 Hoffman ..... B25H 3/003 206/379
3,858,325 A * 1/1975 Goerler ..... G01B 3/36 33/199 R
D249,477 S * 9/1978 Lordahl ..... D10/64
4,503,972 A * 3/1985 Nelligan ..... B25H 3/003 206/369
4,538,354 A * 9/1985 Smolik ..... B23B 47/28 33/563
4,813,551 A * 3/1989 Kuo ..... B25B 13/56 206/377
4,837,939 A * 6/1989 Pullen ..... B25H 1/0078 33/562
5,048,700 A * 9/1991 Feder ..... B07C 7/02 211/70.6
5,121,556 A * 6/1992 Moore ..... B25H 7/02 33/673
5,129,528 A * 7/1992 Eidsmoe ..... B25H 3/003 211/69
5,579,929 A * 12/1996 Schwartz ..... B01L 9/06 206/446
5,845,774 A * 12/1998 Hausknecht ..... B25H 3/003 206/379
6,065,598 A * 5/2000 Anderson ..... B25G 1/085 206/378
6,349,827 B1 * 2/2002 Feder ..... B25H 3/003 206/373
6,474,481 B1 * 11/2002 Liu ..... B25H 3/003 206/377
D471,826 S * 3/2003 Rosenstein ..... D10/64
D487,194 S * 3/2004 Liu ..... D3/319
7,131,796 B2 * 11/2006 Rooney ..... B23B 47/28 408/115 R
7,286,059 B2 * 10/2007 Drake ..... B25H 3/003 206/217
7,424,958 B1 * 9/2008 Eley ..... B25H 3/04 211/70.6
8,371,444 B1 * 2/2013 Huang ..... B25H 3/003 206/373
8,505,720 B2 * 8/2013 Huang ..... B25H 3/00 206/349
8,667,701 B1 * 3/2014 Geesaman ..... A47B 97/00 33/474
8,770,897 B2 * 7/2014 Martin ..... B23B 47/281 408/115 R
8,820,546 B2 * 9/2014 Moore ..... A61C 13/0022 211/13.1
9,107,502 B2 * 8/2015 Heede ..... A47B 96/00
9,193,063 B2 * 11/2015 Huang ..... B25H 3/04
D747,103 S * 1/2016 Amash ..... D3/313
9,539,650 B2 * 1/2017 Frick ..... B23B 47/287
9,625,143 B2 * 4/2017 Hsu ..... F21V 23/04
9,636,752 B2 * 5/2017 Adkin ..... B25H 7/02
9,981,374 B2 * 5/2018 Hinz ..... E04F 21/003
10,047,903 B2 * 8/2018 Bruno ..... A47G 1/164
10,207,333 B2 * 2/2019 Nestleroad ..... B23B 47/287
2003/0085141 A1 * 5/2003 Huang ..... B25H 3/003 206/372
2005/0133394 A1 * 6/2005 Liu ..... A45C 11/00 206/349
2007/0101598 A1 * 5/2007 Miro ..... B23B 47/287 33/667
2011/0056858 A1 * 3/2011 Benczkowski ..... B25H 3/06 206/338
2011/0099826 A1 * 5/2011 Chen ..... B25H 7/02 33/666
2016/0053987 A1 * 2/2016 Hsu ..... F21V 23/04 206/372
2016/0332294 A1 * 11/2016 Heinz ..... B25H 7/02

FOREIGN PATENT DOCUMENTS

EP 0295665 A2 * 12/1988 ..... B23Q 3/15526
GB 110911 A * 1/1918 ..... B25H 3/003

* cited by examiner

400

APPARATUS, METHOD, AND SYSTEM FOR HARDWARE MAPPING AND MANAGEMENT

RELATED APPLICATION

Under provisions of 35 U.S.C. § 120, the Applicant claims the benefit of U.S. non-provisional application Ser. No. 15/193,029, filed Jun. 25, 2016 in the name of Channing Dewitt Wright, an inventor in common with the present application. The present application is a continuation-in-part of the referenced application, which is incorporated herein by reference. It is intended that the referenced application may be applicable to the concepts and embodiments disclosed herein, even if such concepts and embodiments are disclosed in the referenced application with different limitations and configurations and described using different examples and terminology.

FIELD OF DISCLOSURE

The present disclosure generally relates to hardware management.

BACKGROUND

In some situations relating to maintenance, testing, inspection, repair, disassembly of machines, vehicles, and/or equipment, hardware is misplaced, stolen, or lost. For example, during maintenance, testing, inspection, repair, or disassembly of an automobile door assembly, the hardware for securing and fastening one of the parts onto the door assembly may be lost. Furthermore, misplacement of hardware during the disassembly process creates confusion during reassembly as the hardware may not be in the appropriate location. Moreover, the scattering of hardware increases the risk of foreign objects or debris (FOD) and extra parts being present. This may cause additional loss of hardware during the assembly, disassembly, maintenance, testing, inspection, repair, or reassembly processes.

The conventional strategy is to purchase numerous replacement hardware and parts or continue reassembly with missing hardware. This often causes problems and increases risk because the conventional strategy does not account for the misplacement of hardware during reassembly. For example, a technician may place hardware belonging to the fore component of an assembly incorrectly on the aft component resulting in a loose fitting and/or malfunctioning of the equipment. The conventional strategy to address this is to increase staff man hours, provide more specialized staff training, hire security for loss prevention, or installation of added layers of facility security on work sites. These conventional strategies increase overall costs while adding unnecessary layers of complexity to the process. There is a need to provide a more effective solution to these problems and risk factors.

BRIEF OVERVIEW

This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

An Apparatus, Method, and System for Hardware Mapping and Management may be provided. The Apparatus, Method, and System for Hardware Mapping and Management is provided to address the shortcomings of the conventional strategies described, at least in part, in the background.

In some embodiments, the apparatus may be used to track hardware during the process of disassembly, testing, inspection, repair, reconditioning, assembly, reassembly, maintenance of vehicle/equipment/machine and the likeness thereof. Moreover, the apparatus may be used to manage hardware before, after, or during performance any of the aforementioned processes.

Furthermore, the apparatus may be used to map out the hardware in a manner corresponding to the hardware location in the relative part or component of the vehicle/equipment/machine. The apparatus may provide holes or spaces for hardware generically, or in accordance to the mapping. The apparatus may provide identifying labels for one or more holes or spaces for the hardware. The identifying labels may be one or more of graphical, symbolic, numerical, textual, based on a layout, based on the technical schematic, or grouping indication. Further, the apparatus may be color-coded.

In another aspect, the apparatus mapping may be provided such that the mapping corresponds to the component or part being disassembled. The mapping may be such that the schematic of the component or part may be outlined or illustrated in the shape of part or component on the actual apparatus. The apparatus mapping method may be configured such that the arrangement of the holes and spaces on the apparatus align with the manufacturers diagram or schematic of the testing, disassembly, reassembly, maintenance, testing, repair, inspection, or reconditioning of equipment.

This mapping method of the apparatus provides for more efficient disassembly, reassembly, maintenance, testing, repair, inspection, and reconditioning of equipment. This mapping method may assist a technician, mechanic, or laborer to have a clear idea of where to place the hardware based on the location of the hardware on the apparatus relative to the position of the hardware on the part or component of the vehicle/equipment/machine.

Furthermore, the present disclosure provides for an apparatus having one or more of the following elements. The apparatus may be provided with various spacing between the holes configured to hold the hardware. In some embodiments, the spacing may be even and/or irregularly spaced but consistent with technical data configuration. The apparatus hole spacing may control the overall size of the apparatus. The apparatus may be provided with an outline of the apparatus configured to be proportionally smaller in size, while maintaining a shape similar to the parts and components of the equipment relative to the specific assembly. The apparatus may be shaped as rectangle, square, circle, triangle, rhombus, or other shape. The apparatus may be portable wherein the quality of being portable may include but is not limited to: being held in a user's hand, being affixed to a machine or tool cart, being affixed to a wall, being affixed to one or more of: a part, component, vehicle/equipment/machine, another object, another member, or another element.

By way of non-limiting example, embodiments of an apparatus consistent with embodiments of the present disclosure may contain some or all of the following features, comprising, but not limited to:

An apparatus
- comprising:
  - a substrate configured to house hardware associated with an object comprised of hardware units;

one or more holes for housing at least one hardware unit of the object, wherein the one or more holes are within the substrate; and wherein the one or more holes are positioned based on a layout corresponding to the hardware units' assembly within the object.

Furthermore, by way of non-limiting example, embodiments of an apparatus consistent with embodiments of the present disclosure may contain some or all of the following features, comprising, but not limited to:

wherein the one or more holes are configured to secure the at least one hardware unit to the substrate by at least one of the following: threads, fasteners, grommets, eyelets, locks, tightness of grip, and interlocking mechanisms.

wherein the layout of the one or more holes is configured to be one or more of:

one or more holes in an evenly spaced and/or irregularly spaced but consistent with technical data configuration, and one or more holes grouped in a grouping configuration.

wherein the evenly spaced and/or irregularly spaced but consistent with technical data configuration determines the size of the substrate.

wherein the layout of the one or more holes further comprises an identifier wherein the identifier is one or more of: shapes, symbols, scripts, text, colors, numbers, braille, a schematic layout, a schematic shape, a technical specification, and markings.

wherein the layout of the one or more holes further comprises a mapping according to the object.

wherein the mapping further comprises a first location of one or more holes on the substrate corresponding to a second location of the hardware the object.

wherein the layout of the apparatus is:

similar in shape to the object; and is proportionally smaller than the object.

wherein the substrate is one or more of: a rectangle, a triangle, a square, a circle, an oval, a shape.

wherein the apparatus is portable.

wherein the apparatus is configured to be one or more of:

handheld;

affixed to another object;

affixed to another member; and affixed to wheels.

By way of non-limiting example, embodiments of a method consistent with embodiments of the present disclosure may contain some or all of the following stages, comprising, but not limited to:

A method comprising:

disassembling of a first component comprising a hardware unit at an assembly position within the first component, wherein disassembling further comprises removing the hardware unit from the first component;

placing the removed hardware unit of the first component into at least one hole within a first substrate configured to house the first hardware unit, wherein placing the removed hardware unit comprises placing the removed hardware unit at a disassembly position within the first substrate, wherein the disassembly position for housing the removed hardware unit within the first substrate is relatively proportional to the assembly position of the hardware unit within the first component.

Furthermore, by way of non-limiting example, embodiments of a method consistent with embodiments of the present disclosure may contain some or all of the following stages, comprising, but not limited to:

reassembling the first component, wherein reassembling the first component further comprises:

removing the hardware from the first substrate; and replacing the removed hardware into the first component.

wherein disassembling further comprises removing the one or more parts of the first component in a first sequential order or mechanically practical order.

wherein replacing the removed hardware further comprises replacing the removed hardware in a reversed sequential order or mechanically practical order.

wherein the reversed sequential order is a performance of the first sequential order in reverse or mechanically practical order.

wherein placing the removed hardware further comprises placing the removed hardware in the first substrate in a second sequential order or mechanically practical order corresponding to the first sequential order of disassembling.

wherein the disassembly position of the hardware unit within the first substrate maps directly to the assembly position of the hardware unit within the first component.

wherein the assembly position of the hardware unit within the first component maps directly to the disassembly position of the hardware unit within the first substrate in accordance with a schematic of the first component.

Further still, by way of non-limiting example, embodiments of a method consistent with embodiments of the present disclosure may contain some or all of the following stages, comprising, but not limited to:

A method, comprising:

providing a plurality of substrates for housing hardware associated with an object comprised of at least two components and at least one hardware unit for each component, wherein providing the plurality of substrates comprises:

configuring a first plurality of holes within a first substrate of the plurality of substrate, wherein the first plurality of holes are laid out within the first substrate at locations relative to the location of hardware units within a first component, and configuring a second plurality of holes within a second substrate of the plurality of substrate, wherein the second plurality of holes are laid out within the second substrate at locations relative the location of hardware units within a second component.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicant. In addition, the drawings may contain other marks owned by third parties and are being used for illustrative purposes only. All rights to various trademarks and copyrights represented herein, except those belonging to their respective owners, are vested in and the property of the Applicant. The Applicant retains and reserves all rights in its trademarks and copyrights included herein, and grants permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure. In the drawings.

DETAILED DESCRIPTION

Figure 1:
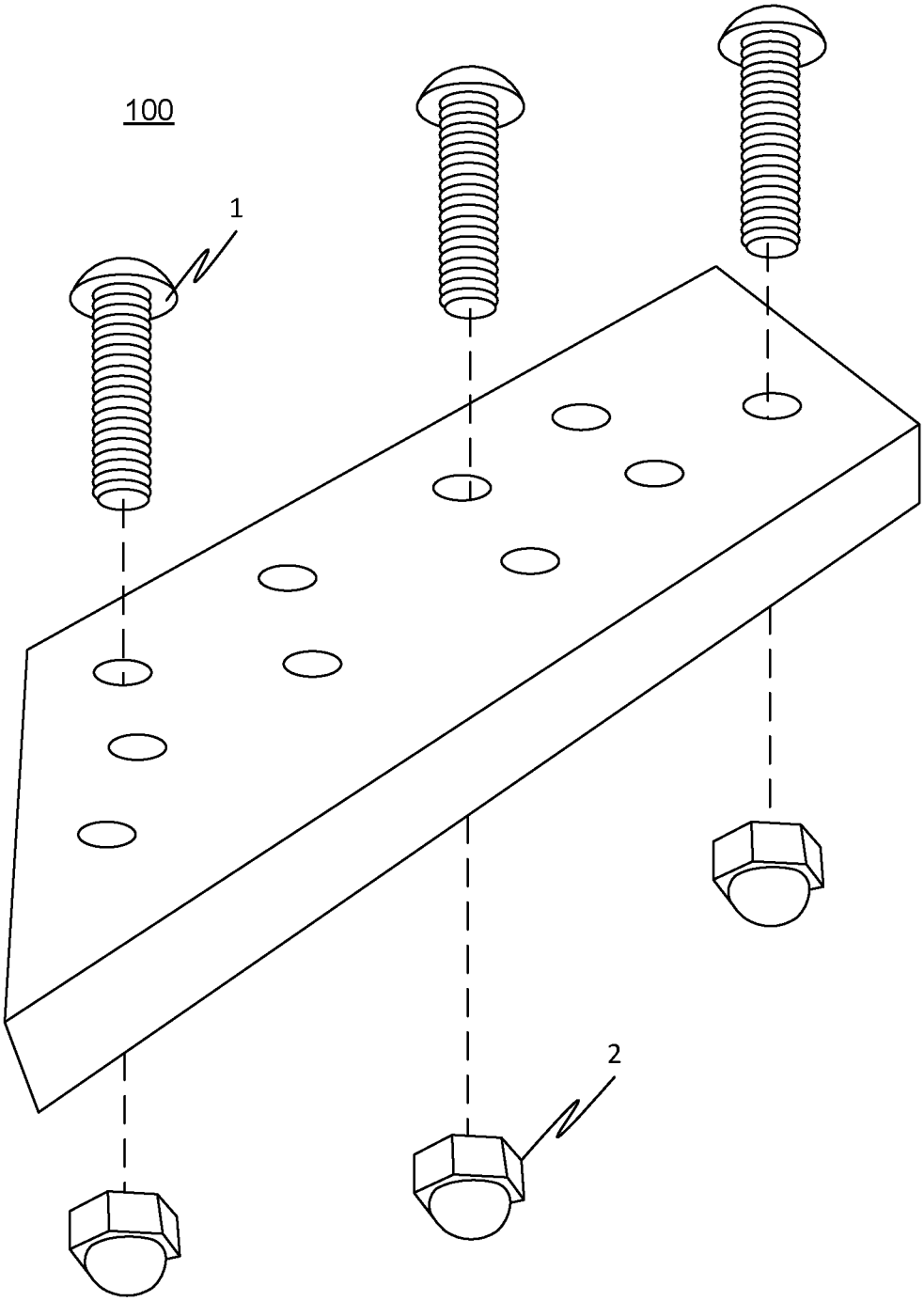
FIG. 1 illustrates an apparatus housing hardware consistent with the present disclosure.
Figure 2:
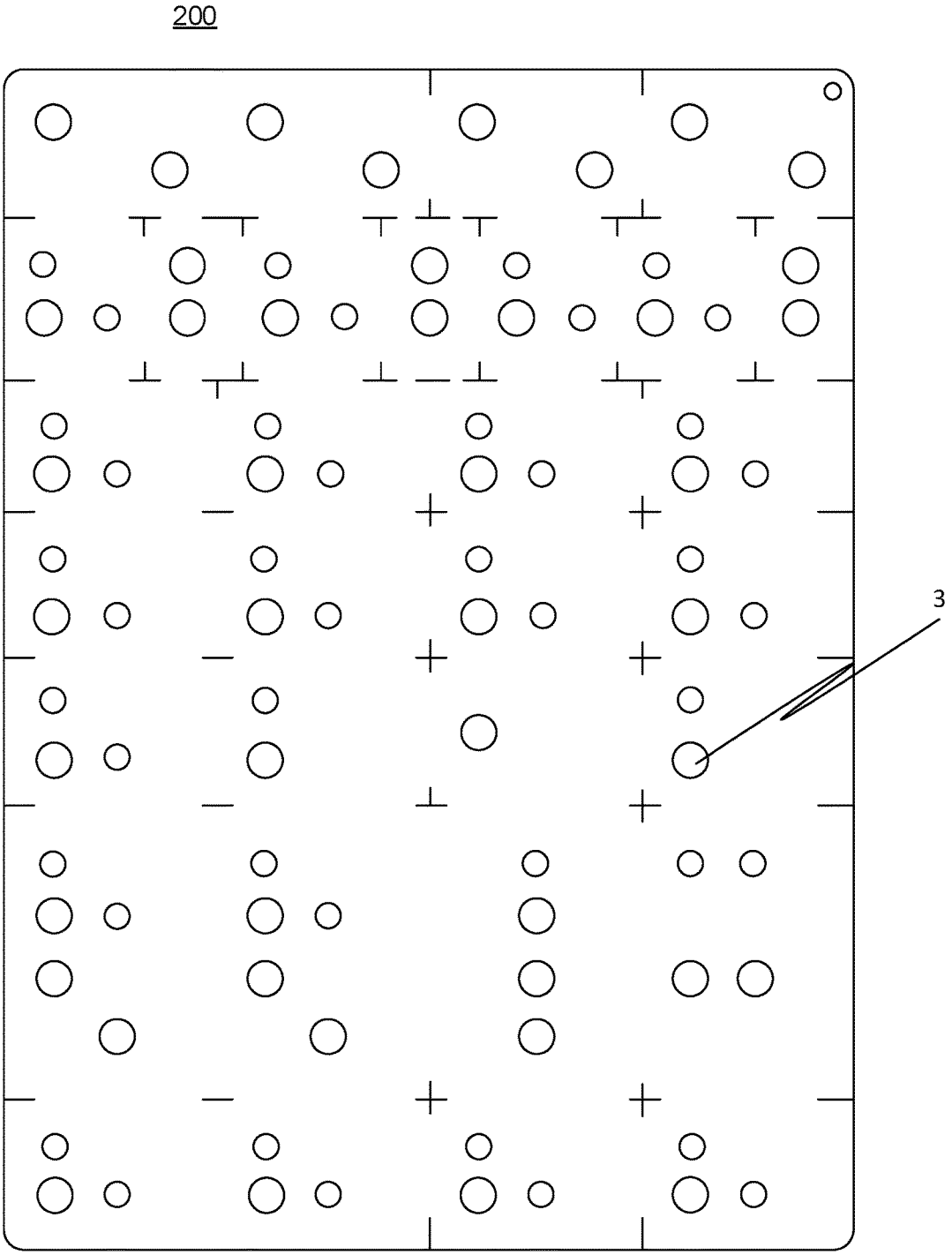
FIG. 2 illustrates an apparatus consistent with the present disclosure.
Figure 3:
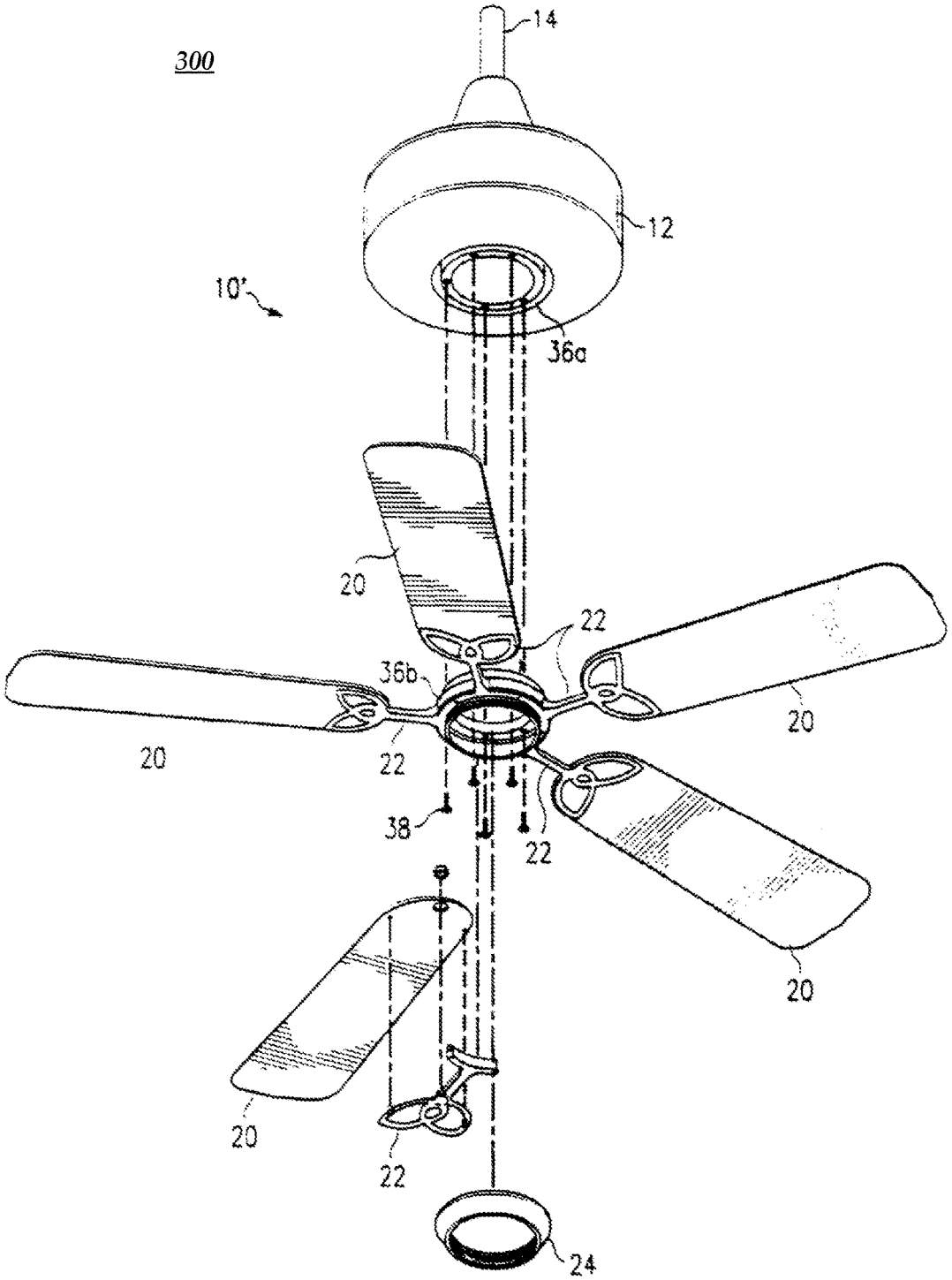
FIG. 3 illustrates a manufacturer's ceiling fan assembly consistent with the present disclosure.
Figure 4:
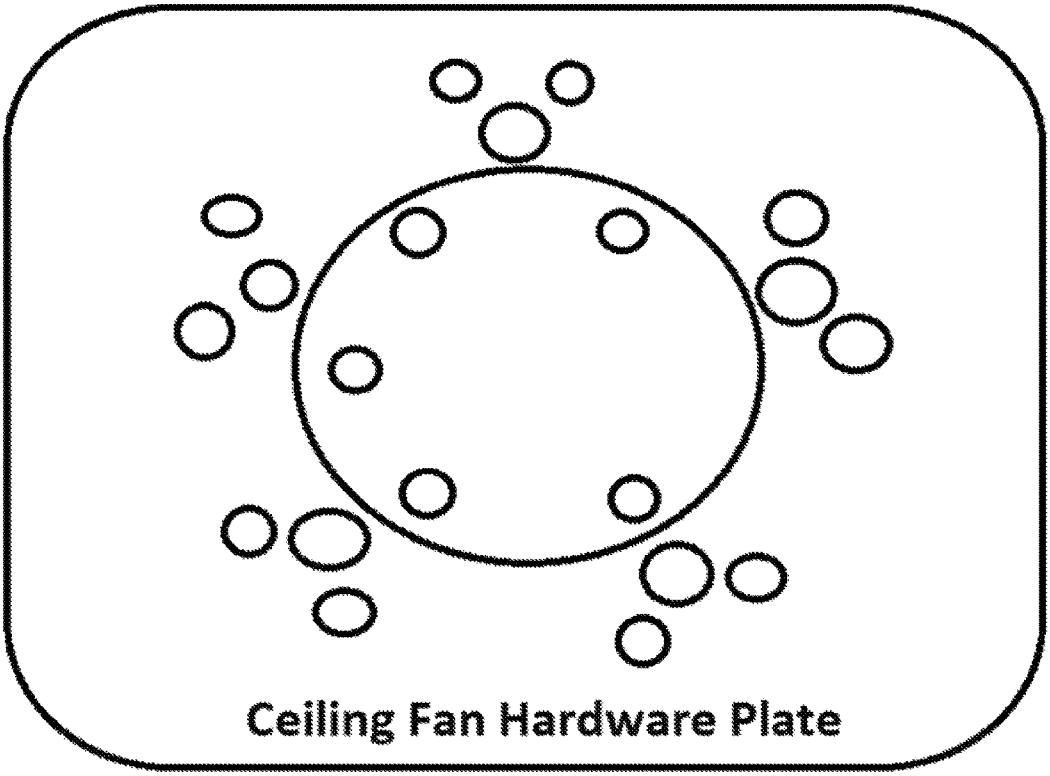
FIG. 4 illustrates an apparatus configured for the ceiling fan assembly consistent with the present disclosure.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in, the context of hardware management relating to maintenance, testing, disassembly of machines, vehicles, and equipment, embodiments of the present disclosure are not limited to use only in this context.

I. Definitions

Regarding the present disclosure, a description of the following terminology is provided to clearly express manners of utilizing the present disclosure as it relates to maintenance, testing, inspection, repair, reassembly, assembly, disassembly, reconditioning and storage of machines, vehicles, and equipment. It should be understood that these terms are non-limiting definitions, but only a highlighted portion of the definition.

Hardware may include but is not limited to: screws, nuts, bolts, fasteners, clasps, latches, hooks, fastening devices, locks, hinges, wings, and interlocking clamps. Hardware may be used for but is not limited to: connecting, assembling, reassembling, disassembling, holding together, fastening, securing, and the like elements including but not limited to components, parts, and equipment. A single unit of hardware may be referred to as a hardware unit. It should be understood that there can be multiple types of hardware units, and that the design of the hole in a substrate may be based on the hardware unit type.

Component: may include but is not limited to: an engine, a hydraulic pump, a motor, a bracket, a door, a panel, a hood, a ceiling fan assembly, and countless machine or equipment components. A component may be comprised of parts.

Part: may include but is not limited to: a shelving system, a hydraulic system, a flight control system, a propulsion unit, a device, a mechanism, and various machine or equipment parts. Parts may be comprised of at least one or more hardware; hardware connected with other members and/or elements. Component and part may be at times used interchangeably.

Equipment: may include but is not limited to: vehicles, machines, boats, ships, vessels, transportation device, space shuttle, space flight equipment, planes, aviation equipment, rockets, missiles, projectile weaponry, bombs, buildings, habitations, hulls, mechanical equipment, electronic equipment, tools, objects, powered tools, powered objects, powered assemblies, nautical equipment, helicopters, spacecraft, time machines, nuclear equipment, military equipment, civilian equipment and the like thereof.

Object: An object may include one or more of but is not limited to: a part, component, and equipment.

Identifier: A layout or marking of shapes, symbols, script, text, color, numbers, braille.

II. Overview

Consistent with embodiments of the present disclosure, An Apparatus, Method, and System for Hardware Mapping and Management may be provided. This overview is provided to introduce a selection of concepts in a simplified form that are further described below. This overview is not intended to identify key features or essential features of the claimed subject matter. Nor is this overview intended to be used to limit the claimed subject matter's scope. The Apparatus, Method, and System for Hardware Mapping and Management may be used by individuals or companies to track hardware during the process of disassembly, testing, inspection, repair, reconditioning, assembly, reassembly, maintenance of equipment and the likeness thereof. Moreover, the apparatus may be used to manage hardware before, after, or during performance of any of the aforementioned processes.

Furthermore, the apparatus may be used to map out the hardware in a manner corresponding to the hardware location in the relative part or component of the equipment. The apparatus may provide holes or spaces for hardware. The apparatus may provide identifying labels for one or more holes or spaces for the hardware. The identifying labels may be one or more of but is not limited to: graphical, textual, layout shapes, symbols, script, text, color, numbers, color coding, braille and the likeness thereof. Moreover, identifying labels may be one or more of but is not limited to: based on a layout, based on the technical schematic, or grouping indication.

In another aspect, the apparatus mapping may be provided such that the mapping corresponds to the component or part being disassembled. The mapping may be such that the schematic of the component or part may be outlined or illustrated in the shape of part or component on the actual apparatus. The apparatus mapping method may be configured such that the arrangement of the holes and spaces on the apparatus align with the manufacturers diagram or schematic of the equipment.

This mapping method of the apparatus provides for more efficient disassembly, testing, inspection, repair, assembly, reassembly, maintenance of equipment and reconditioning of equipment. This mapping method helps a technician, mechanic, or laborer to have a clear idea of where to place the hardware based on the location of the hardware on the apparatus relative to the position of the hardware on the part or component of the equipment.

Furthermore, the present disclosure provides for an apparatus having one or more of the following elements. The apparatus may be provided with even spacing or irregular spacing but consistent with technical data between the holes configured to hold the hardware. The apparatus hole spacing may control the overall size of the apparatus. The apparatus may be provided with an outline of the apparatus configured to be proportionally smaller in size, while maintaining a shape similar to the parts and components of the equipment relative to the specific assembly. The apparatus may be shaped as rectangle, square, circle, triangle, rhombus, or other shape. The apparatus may be portable wherein the quality of being portable may include but is not limited to: being held in a user's hand, being affixed to a machine or tool cart, being affixed to a wall, being affixed to one or more of: a part, component, equipment, another object, another member, or another element.

The present disclosure provides for an Apparatus, Method, and System for Hardware Mapping and Management which may be specially designed for vehicle maintenance installation, vehicle maintenance disassembly, and vehicle maintenance assembly. The present disclosure may comprise key design elements providing for foreign object or debris (FOD) avoidance. The present disclosure may provide for a receptacle that maps out the location of a hardware unit (nuts, bushing, locking rings, screws, bolts, fasteners, etc.) to a corresponding location on an object, vehicle part or vehicle component.

The present disclosure may be embodied on a system in a manner configured to identify the installation of hardware units into a substrate. The substrate may comprise lightweight materials such as aluminum, copper, steel, carbon fiber, one or more other elements or a combination thereof. The substrate may be marked with indicators and/or identifying markings to reduce the likelihood of incorrect hardware installation. A plurality of substrates may be provided such that each may be specifically designed for use only with a particular object, component, vehicle part, equipment or assembly without any mixing and matching of hardware units or objects.

The present disclosure may be customized for a particular maintenance installation, disassembly, or assembly. The present disclosure may be reusable for a plurality of maintenance installations, disassembly, or assemblies. The present disclosure may be designed such that it may be error proofed in order to prevent the incorrect hardware from being used during maintenance. The present disclosure may be configured to reduce the time of visual inspection relating to maintenance, assembly and disassembly.

Generally, the present disclosure is not used for tooling or storage of tools. In other embodiments, the present disclosure may be adapted for tooling in specific cases. For example, if the tooling is part of the object for a particular maintenance installation, disassembly, or assembly.

The present disclosure may be configured for loss prevention of hardware units during assembly, disassembly, and maintenance. The present disclosure may be configured for tracking hardware units. The present disclosure may be configured to help a user remember where hardware units should be located in the assembly. The present disclosure may be configured to help a user correctly locate removed hardware.

In accordance with the present disclosure, an Apparatus for managing hardware and mapping hardware to a corresponding object is provided. The apparatus may comprise substrate wherein the substrate may be configured to have flat surface, raised surface, sunken surface, or another surface. The substrate may comprise at least one hole. The at least one hole may be identified by grouping, location, or other indications or markings. Such indications or markings may be textual. Such indications or markings may be based on layout to an object Schematic. This layout may be configured such that the location of hardware units is intuitive with no additional text needed.

The present disclosure may be configured wherein each at least one hole is mapped out in accordance with a mapping system. The mapping system may be configured such that the location of the at least one hole in the substrate corresponds to the object location of the hardware unit in the disassembled object. The mapping system may be configured such that a Schematic of the object will be outlined or etched into the substrate and/or adhered or bonded to the substrate. The mapping system may be configured such that hardware units can be placed into the substrate in the relative location of where it belongs on the disassembled object. The mapping system may be configured such that reassembling the object will be quicker and more efficient.

In accordance with the present disclosure, the mapping system may be configured such that a user may place the substrate side by side or adjacent to the object being actively dissembled. The mapping system may be configured such that hardware unit positions correspond in design and location to the related and associated object. More importantly, the mapping system may be configured such that the arrangement of holes aligns with the manufacturers diagram, schematic, figure, drawing, or technical representation of the object. Further, the mapping system may be configured such that a hardware unit is placed into the substrate in a relative location of where it would be positioned and fastened onto the object.

In accordance with the present disclosure, the substrate may be configured such that the at least one hole has even spacing and/or irregularly spacing but consistent with technical data. Further, the substrate may be configured wherein the spacing controls the size of the apparatus. The substrate may be configured wherein the outline of the apparatus may be proportionally smaller but same in shape to the object. The substrate may be configured such that it may be rectangular in shape or of another shape. The substrate may be configured such that it may be portable. The substrate may be configured such that it may be held in a user's hand(s). The substrate may be configured such that it may be affixed to another object. The substrate may be configured such that it may be colored coded.

Although modules, elements, components, and objects are disclosed with specific functionality, it should be understood that functionality may be shared between objects, with some functions split between objects, while other functions duplicated by the objects. Furthermore, the name of the object should not be construed as limiting upon the functionality of the object. Moreover, each stage in the claim language can be considered independently without the context of the other stages. Each stage may contain language defined in other portions of this specifications. Each stage disclosed for one module may be mixed with the operational stages of another module. Each stage can be claimed on its own and/or interchangeably with other stages of other modules. The following claims will detail the operation of each object, and inter-operation between objects.

III. Implementation

FIGS. 1, 2, 3, 4 and 5 illustrate non-limiting examples of operating environments for the aforementioned modules. Although modules are disclosed with specific functionality, it should be understood that functionality may be shared between modules, with some functions split between modules, while other functions duplicated by the modules. Furthermore, the name of the module should not be construed as limiting upon the functionality of the module. Moreover, each stage in the claim language can be considered independently without the context of the other stages. Each stage may contain language defined in other portions of these specifications. Each stage disclosed for one module may be mixed with the operational stages of another module. Each stage can be claimed on its own and/or interchangeably with other stages of other modules. The following claims will detail the operation of each module, and inter-operation between modules.

A. Embodiments of the Present Disclosure Provide a Hardware and/or Software Platform to Operate Machinery Configured for Manufacturing an Apparatus Consistent with the Various Embodiments Herein. The Method May Comprise, but not be Limited to:

A method, comprising:

providing a plurality of substrates for housing hardware associated with an object comprised of at least two components and at least two hardware units for each component, wherein providing the plurality of substrates comprises:

configuring a first plurality of holes within a first substrate of the plurality of substrate, wherein the first plurality of holes are laid out within the first substrate at locations relative to the location of hardware units within a first component, and configuring a second plurality of holes within a second substrate of the plurality of substrate, wherein the second plurality of holes are laid out within the second substrate at locations relative the location of hardware units within a second component.

Wherein configuring the first plurality of holes and the second plurality of holes may comprise:

identifying an object, component, or part, identifying hardware with the object, component, or part, determining a layout of the hardware within the object, component, or part, Wherein determining the layout of the hardware comprises Accessing a database of preconfigured layouts, and retrieving a layout corresponding to the hardware layout, Customizing a layout based on a mapping of the hardware within the object, component, or part, positioning one or more holes within a substrate based on the layout.

Various hardware and software components may be used at the various stages of operations follow the method and computer-readable medium. For example, robotic and computerized machinery may be used with image processing techniques. For example, although the methods have been described to be performed by a computing device, it should be understood that, in some embodiments, different operations may be performed by different networked elements in operative communication with the computing device. For example, a computing device 600 may be employed in the performance of some or all of the stages disclosed with regard to the methods below. The computing device may operate, for example, a robotic system for manufacturing and packaging the apparatus.

B. Embodiments of the Present Disclosure Provide a Hardware and Software Platform Operative by a Set of Methods and Computer-Readable Media Comprising Instructions Configured to Operate the Aforementioned Objects and Computing Elements in Accordance with the Methods.

The methods and computer-readable media may comprise a set of instructions which when executed are configured to enable a method for inter-operating at least one of the following modules:

A. An Optical Sensing Module;
B. A Machine Tool Module;
C. Layout Module;
D. Schematic Reading Module;
E. Etching Module;
F. Assembly Module; and
G. Disassembly Module The aforementioned modules may be inter-operated to perform a method comprising the following stages:

1. providing a plurality of substrates for housing hardware associated with an object comprised of at least two components and at least two hardware units for each component, wherein providing the plurality of substrates comprises:
   a. configuring a first plurality of holes within a first substrate of the plurality of substrate, wherein the first plurality of holes are laid out within the first substrate at locations relative the location of hardware units within a first component, and
   b. configuring a second plurality of holes within a second substrate of the plurality of substrate, wherein the second plurality of holes are laid out within the second substrate at locations relative the location of hardware units within a second component.
   c. Wherein configuring the first plurality of holes and the second plurality of holes may comprise:
      i. identifying an object, component, or part,
      ii. identifying hardware with the object, component, or part,
      iii. determining a layout of the hardware within the object, component, or part,
         1. Wherein determining the layout of the hardware comprises
            a. Accessing a database of preconfigured layouts, and retrieving a layout corresponding to the hardware layout,
            b. Customizing a layout based on a mapping of the hardware within the object, component, or part,
      iv. positioning one or more holes within a substrate based on the layout.

Although the stages are disclosed in a particular order, it should be understood that the order is disclosed for illustrative purposes only. Stages may be combined, separated, reordered, and various intermediary stages may exist. Accordingly, it should be understood that the various stages, in various embodiments, may be performed in arrangements that differ from the ones claimed below. Moreover, various stages may be added or removed from the without altering or deterring from the fundamental scope of the depicted methods and systems disclosed herein. For example, a computing device 600 may be employed in the performance of some or all of the stages disclosed with regard to the methods below. The computing device may operate, for example, a robotic system for manufacturing and packaging the apparatus.

C. Embodiments of the Present Disclosure Provide a Method for Using an Apparatus Consistent with the Various Embodiments Herein.

A method, comprising:

disassembling of a first component comprising a hardware unit at an assembly position within the first component, wherein disassembling further comprises removing the hardware unit from the first component;

placing the removed hardware unit of the first component into at least one hole within a first substrate configured to house the first hardware unit, wherein placing the removed hardware unit comprises placing the removed hardware unit at a disassembly position within the first substrate, wherein the disassembly position for housing the removed hardware unit within the first substrate is relatively proportional to the assembly position of the hardware unit within the first component further comprising:

reassembling the first component, wherein reassembling the first component further comprises:

removing the hardware from the first substrate; and replacing the removed hardware into the first component.

wherein disassembling further comprises removing the one or more parts of the first component in a first sequential order or mechanically practical order.

wherein replacing the removed hardware further comprises replacing the removed hardware in a reversed sequential order or mechanically practical order.

wherein the reversed sequential order or mechanically practical order is a performance of the first sequential order or mechanically practical order in reverse.

wherein placing the removed hardware further comprises placing the removed hardware in the first in a second sequential order or mechanically practical order corresponding to the first sequential order or mechanically practical order of disassembling.

wherein the disassembly position of the hardware unit within the first substrate maps directly to the assembly position of the hardware unit within the first component.

wherein the assembly position of the hardware unit within the first component maps directly the disassembly position of the hardware unit within the first substrate in accordance with a schematic of the first component.

IV. Operation

Figure 5:
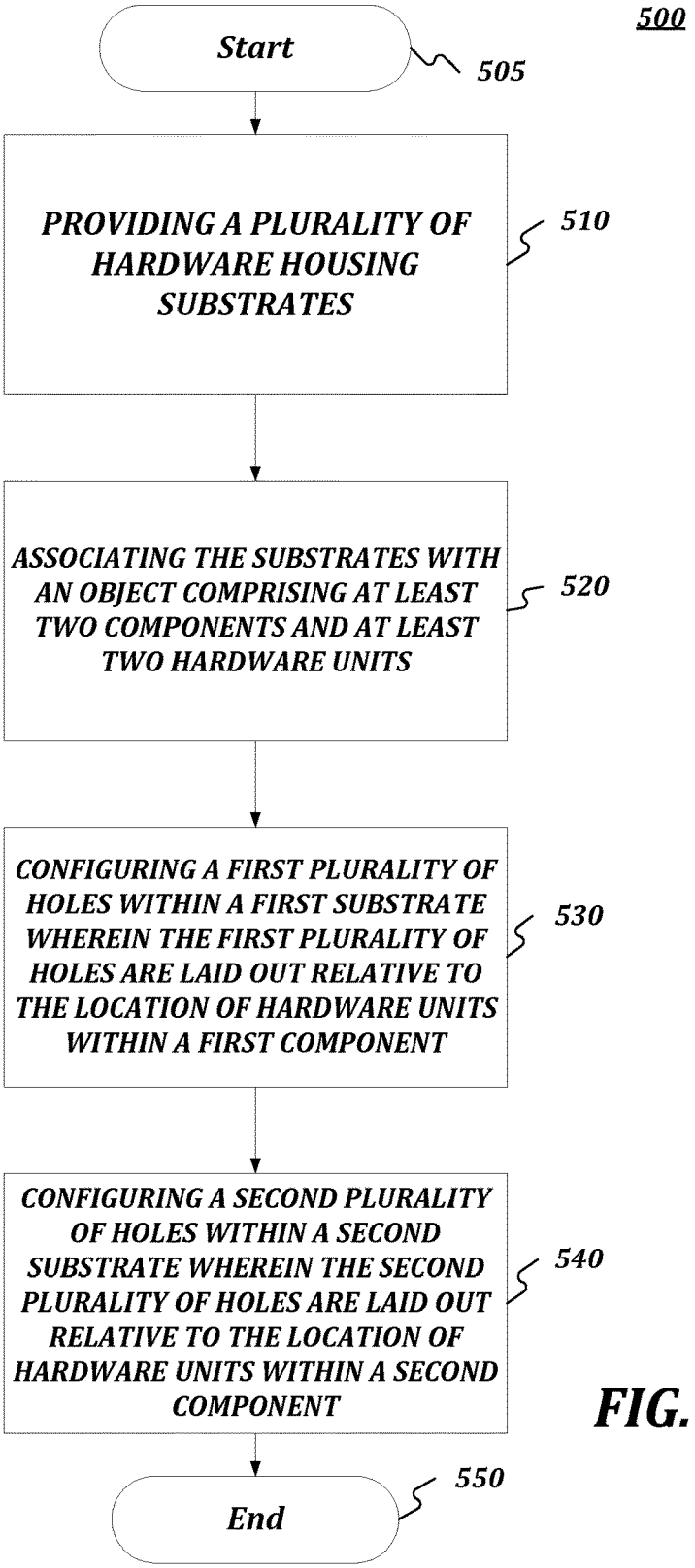
FIG. 5 is a flow chart of a method for providing Hardware Mapping and Management.

FIG. 5 is a flow chart setting forth the general stages involved in a method 500 consistent with an embodiment of the disclosure for providing an apparatus. Examples of an apparatus consistent with embodiments of the present disclosure may be referred to as a Skyplate™ apparatus. Method 500 may be implemented using a computing device 600 as described in more detail below with respect to FIG. 6.

Although method 500 has been described to be performed by computing device 600, it should be understood that, in some embodiments, different operations may be performed by different networked elements in operative communication with computing device 600. For example, a server and/or computing device 600 may be employed in the performance of some or all of the stages in method 500. Moreover, a server may be configured much like computing device 600 and, in some instances, be one and the same embodiment. Similarly, apparatus may be employed in the performance of some or all of the stages in method 500. Apparatus may also be configured much like computing device 600.

Although method 500 has been described to be performed by a computing and robotic implementation (e.g., Skyplate computing platform), it should be understood that computing device 600 may be used to perform the various stages of method 500. Furthermore, in some embodiments, different operations may be performed by different networked elements in operative communication with computing device 600. For example, a server may be employed in the performance of some or all of the stages in method 500. Moreover, a server may be configured much like computing device 600. Similarly, an apparatus may be employed in the performance of some or all of the stages in method 500. Apparatus may also be configured much like computing device 600.

Although the stages illustrated by the flow charts are disclosed in a particular order, it should be understood that the order is disclosed for illustrative purposes only. Stages may be combined, separated, reordered, and various intermediary stages may exist. Accordingly, it should be understood that the various stages illustrated within the flow chart may be, in various embodiments, performed in arrangements that differ from the ones illustrated. Moreover, various stages may be added or removed from the flow charts without altering or deterring from the fundamental scope of the depicted methods and systems disclosed herein. Ways to implement the stages of method 500 will be described in greater detail below.

Method 500 may begin at starting block 505 and proceed to stage 510 where computing device 600 may provide a plurality of hardware housing substrates.

From stage 510, where computing device 600 provides a plurality of hardware housing substrates, method 500 may advance to stage 520 where computing device 600 may associate the substrates with an object comprising at least two components and at least two hardware units. For example, a first component may be a ceiling fan assembly and a second component may be a helicopter assembly. In some embodiments, computing device 600 may use image processing techniques to map out a diagram of the object and its components so as to enable the mapped configuration of holes within one or more substrates.

Once computing device 600 associates the substrates with an object comprising at least two components and at least two hardware units in stage 520, method 500 may continue to stage 530 where computing device 600 may configure a first plurality of holes within a first substrate wherein the first plurality of holes are laid out relative to the location of hardware units within a first component. For example, the first plurality of holes within the first skyplate may be laid out relative to a ceiling fan assembly.

After computing device 600 configures a first plurality of holes within a first substrate wherein the first plurality of holes are laid out relative to the location of hardware units within a first component in stage 530, method 500 may proceed to stage 540 where computing device 600 may configure a second plurality of holes within a second substrate wherein the second plurality of holes are laid out relative to the location of hardware units within a second component. For example, the second plurality of holes within a second substrate may be laid out relative to a helicopter assembly. Once computing device 600 configures a second plurality of holes within a second substrate wherein the second plurality of holes are laid out relative to the location of hardware units within a second component in stage 540, method 500 may then end at stage 550.

V. Computing Device Architecture

A computing platform consistent with the present disclosure may be embodied as, for example, computerized machinery for manufacturing an apparatus consistent with embodiments of the present disclosure, but not be limited to, a website, a web application, a desktop application, and a mobile application compatible with a computing device.

The platform may be operated by a user through, for example, but not be limited to, a desktop computer, laptop, a tablet, a machine tooling system, a laser etching system, a fabrication machine, or mobile telecommunications device. Moreover, the computing platform may be hosted on a centralized server, such as, for example, a cloud computing service. Although method 500 has been described to be performed by a computing device 600, it should be understood that, in some embodiments, different operations may be performed by different networked elements in operative communication with computing device 600.

Embodiments of the present disclosure may comprise a system having a memory storage and a processing unit. The processing unit coupled to the memory storage, wherein the processing unit is configured to perform the stages of method 500.

Figure 6:
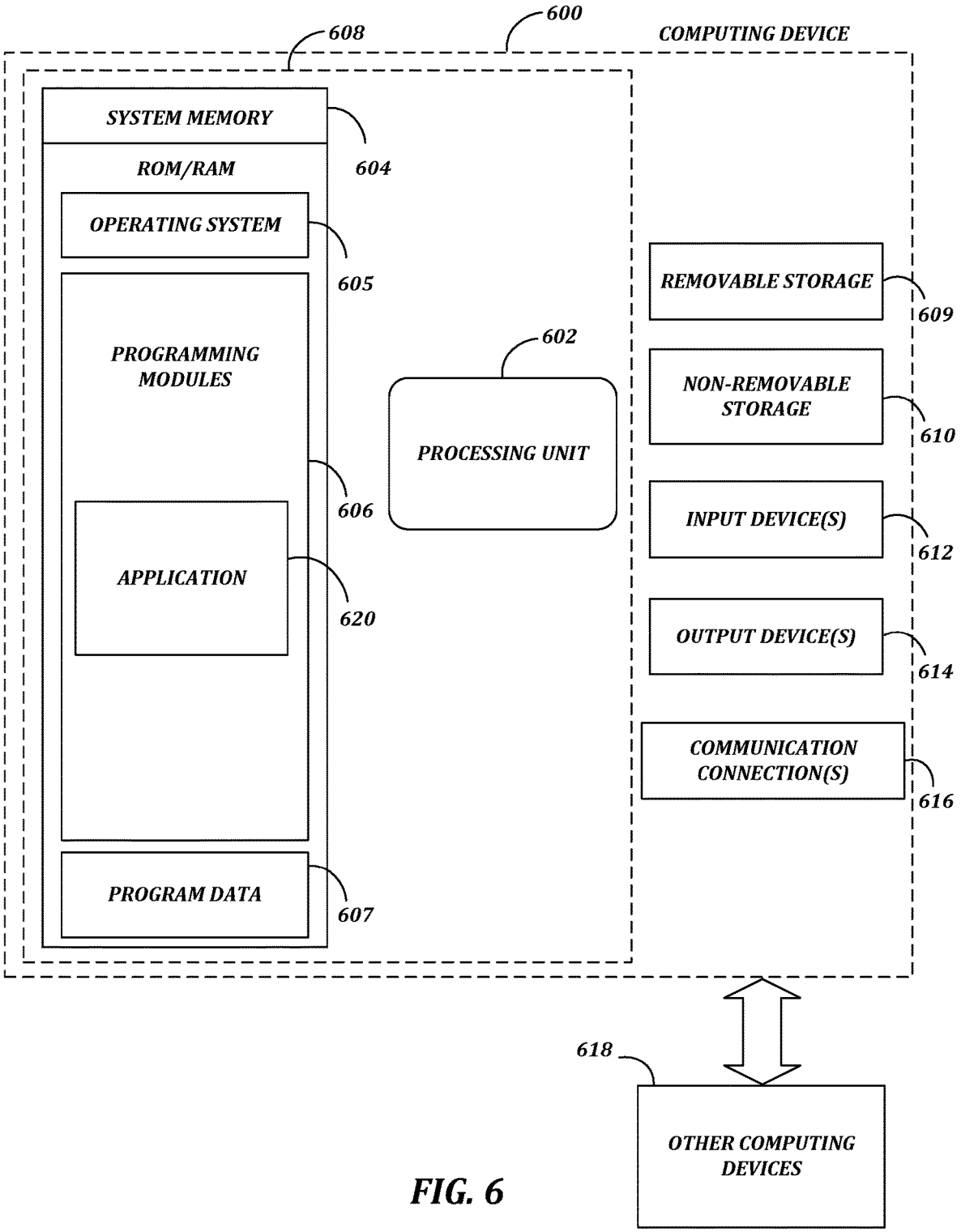
FIG. 6 is a block diagram of a system including a computing device for performing the method of FIG. 5.

FIG. 6 is a block diagram of a system including computing device 600. Consistent with an embodiment of the disclosure, the aforementioned memory storage and processing unit may be implemented in a computing device, such as computing device 600 of FIG. 6. Any suitable combination of hardware, software, or firmware may be used to implement the memory storage and processing unit. For example, the memory storage and processing unit may be implemented with computing device 600 or any of other computing devices 618, in combination with computing device 600. The aforementioned system, device, and processors are examples and other systems, devices, and processors may comprise the aforementioned memory storage and processing unit, consistent with embodiments of the disclosure.

With reference to FIG. 6, a system consistent with an embodiment of the disclosure may include a computing device, such as computing device 600. In a basic configuration, computing device 600 may include at least one processing unit 602 and a system memory 604. Depending on the configuration and type of computing device, system memory 604 may comprise, but is not limited to, volatile (e.g. random access memory (RAM)), nonvolatile (e.g. read-only memory (ROM)), flash memory, or any combination. System memory 604 may include operating system 605, one or more programming modules 606, and may include a program data 607. Operating system 605, for example, may be suitable for controlling computing device 600's operation. In one embodiment, programming modules 606 may include (e.g., machine tool modules, layout modules, schematic reading modules, skyplate modules, application 620). Furthermore, embodiments of the disclosure may be practiced in conjunction with a graphics library, other operating systems, or any other application program and is not limited to any particular application or system. This basic configuration is illustrated in FIG. 6 by those components within a dashed line 608.

Computing device 600 may have additional features or functionality. For example, computing device 600 may also include additional data storage devices (removable and/or non-removable) such as, for example, magnetic disks, optical disks, or tape. Such additional storage is illustrated in FIG. 6 by a removable storage 609 and a non-removable storage 610. Computer storage media may include volatile and nonvolatile, removable and non-removable media implemented in any method or technology for storage of information, such as computer readable instructions, data structures, program modules, or other data. System memory 604, removable storage 609, and non-removable storage 610 are all computer storage media examples (i.e., memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 600. Any such computer storage media may be part of device 600. Computing device 600 may also have input device(s) 612 such as a keyboard, a mouse, a pen, a sound input device, a touch input device, etc. Output device(s) 614 such as a display, speakers, a printer, etc. may also be included. The aforementioned devices are examples and others may be used.

Computing device 600 may also contain a communication connection 616 that may allow device 600 to communicate with other computing devices 618, such as over a network in a distributed computing environment, for example, an intranet or the Internet. Communication connection 616 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both storage media and communication media.

As stated above, a number of program modules and data files may be stored in system memory 604, including operating system 605. While executing on processing unit 602, programming modules 606 (e.g., machine tool modules, layout modules, schematic reading modules, skyplate modules, application 620) may perform processes including, for example, one or more of method 500's stages as described above. The aforementioned process is an example, and processing unit 602 may perform other processes. Other programming modules that may be used in accordance with embodiments of the present disclosure may include electronic mail and contacts applications, word processing applications, spreadsheet applications, database applications, slide presentation applications, drawing or computer-aided application programs, etc.

Generally, consistent with embodiments of the disclosure, program modules may include routines, programs, components, data structures, and other types of structures that may perform particular tasks or that may implement particular abstract data types. Moreover, embodiments of the disclosure may be practiced with other computer system configurations, including hand-held devices, multiprocessor systems, microprocessor-based or programmable consumer electronics, minicomputers, mainframe computers, and the like. Embodiments of the disclosure may also be practiced in distributed computing environments where tasks are performed by remote processing devices that are linked through a communications network. In a distributed computing environment, program modules may be located in both local and remote memory storage devices.

Furthermore, embodiments of the disclosure may be practiced in an electrical circuit comprising discrete electronic elements, packaged or integrated electronic chips containing logic gates, a circuit utilizing a microprocessor, or on a single chip containing electronic elements or microprocessors. Embodiments of the disclosure may also be practiced using other technologies capable of performing logical operations such as, for example, AND, OR, and NOT, including but not limited to mechanical, optical, fluidic, and quantum technologies. In addition, embodiments of the disclosure may be practiced within a general purpose computer or in any other circuits or systems.

Embodiments of the disclosure, for example, may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present disclosure may be embodied in hardware and/or in software (including firmware, resident software, micro-code, etc.). In other words, embodiments of the present disclosure may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random access memory (RAM), a read-only memory (ROM), an erasable programmable read-only memory (EPROM or Flash memory), an optical fiber, and quantum computing elements. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the disclosure have been described, other embodiments may exist. Furthermore, although embodiments of the present disclosure have been described as being associated with data stored in memory and other storage mediums, data can also be stored on or read from other types of computer-readable media, such as secondary storage devices, like hard disks, solid state storage (e.g., USB drive), or a CD-ROM, a carrier wave from the Internet, or other forms of RAM or ROM. Further, the disclosed methods' stages may be modified in any manner, including by reordering stages and/or inserting or deleting stages, without departing from the disclosure.

I. ASPECTS

The following disclose various Aspects of the present disclosure. The various Aspects are not to be construed as patent claims unless the language of the Aspect appears as a patent claim. The Aspects describe various non-limiting embodiments of the present disclosure.

Aspect 1. A skyplate apparatus comprising:

a flat substrate, wherein the substrate further comprises one or more of aluminum, copper, metal, steel, or another element;

one or more holes, wherein the one or more holes are drilled into the substrate; and wherein the one or more holes are positioned based on a schematic of one or more of an equipment, a part, a component, a tool, and a vehicle.

Aspect 2. The skyplate apparatus of Aspect 1, wherein the one or more holes are configured to hold hardware.

Aspect 3. The skyplate apparatus of Aspect 2, wherein the one or more holes are configured to hold hardware secure the hardware to the substrate by one or more of: threads, fasteners, grommets, eyelets, locks, tightness of grip, and interlocking mechanisms.

Aspect 4. The skyplate apparatus of Aspect 1, wherein the layout of the one or more holes is configured to be one or more of:

one or more holes in an evenly spaced and/or irregularly spaced but consistent with technical data configuration, and one or more holes grouped in a grouping configuration.

Aspect 5. The skyplate apparatus of Aspect 4, wherein the evenly spaced and/or irregularly spaced but consistent with technical data configuration determines the size of the substrate.

Aspect 6. The skyplate apparatus of Aspect 1, wherein the layout of the one or more holes further comprises an identifier, wherein the identifier is one or more of: shapes, symbols, scripts, text, colors, numbers, braille, a schematic layout, a schematic shape, a technical specification, and markings; and wherein the identifier is etched into the substrate and/or adhered or bonded to the substrate.

Aspect 7. The skyplate apparatus of Aspect 1, wherein the layout of the one or more holes further comprises a mapping according to one or more of:

a component, a part, a schematic, a technical diagram, and an outline.

Aspect 8. The skyplate apparatus of Aspect 7, wherein the mapping further comprises:

a first location of one or more holes on the substrate corresponding to a second location of the hardware on one or more of: the component, the part, a tool, and an equipment;

wherein the first location of one or more holes on the skyplate apparatus corresponds to the second location based on the schematic of the equipment.

Aspect 9. The skyplate apparatus of Aspect 8, wherein the layout of the apparatus is:

similar in shape to the equipment; and is proportionally smaller than the equipment.

Aspect 10. The skyplate apparatus of Aspect 1, wherein the apparatus is one or more of: a rectangle, a triangle, a square, a circle, an oval, a shape.

Aspect 11. The skyplate apparatus of Aspect 1, wherein the apparatus is portable.

Aspect 12. The skyplate apparatus of Aspect 1, wherein the apparatus is configured to be one or more of:

handheld;

affixed to another object;

affixed to another member; and affixed to wheels.

Aspect 13. A method comprising:

disassembling of a component, wherein disassembling further comprises removing a hardware from the first component;

placing the removed hardware of the first component into a first skyplate corresponding to the first component;

reassembling the first component, wherein reassembling the first component further comprises:

removing the hardware from the first skyplate; and replacing the removed hardware into the first component.

Aspect 14. The method of Aspect 13, wherein the first component further comprises one or more parts.

Aspect 15. The method of Aspect 13, wherein disassembling further comprises removing the one or more parts of the first component in a first sequential order or mechanically practical order.

Aspect 16. The method of Aspect 15, wherein replacing the removed hardware further comprises replacing the removed hardware in a reversed sequential order or mechanically practical order.

Aspect 17. The method of Aspect 16, wherein the reversed sequential order or mechanically practical order is a performance of the first sequential order or mechanically practical order in reverse.

Aspect 18. The method of Aspect 13, wherein placing the removed hardware further comprises placing the removed hardware in the first skyplate in a second sequential order or mechanically practical order corresponding to the first sequential order or mechanically practical order of disassembling.

Aspect 19. The method of Aspect 13, wherein the first component further comprises one of more of: a part, a tool, a vehicle, and an equipment.

Aspect 20. A computer readable medium comprising:
- a processor;
- a memory; and
- a set of instructions which when executed are configured to enable the method comprising:
- disassembling of an equipment, wherein the equipment comprises a first component and a second component, wherein disassembling a first component comprises:
  - removing a first hardware from the first component;
  - placing the first removed hardware of the first component into a first skyplate resulting in a first skyplate hardware;
  - wherein disassembling a second component comprises:
    - removing a second hardware from the second component;
    - placing the second removed hardware of the second component into a second skyplate resulting in a second skyplate hardware;
- reassembling of the equipment, wherein reassembling further comprises:
  - reassembling the first component, wherein reassembling the first component further comprises:
    - removing the first skyplate hardware resulting in the first removed hardware;
    - replacing the first removed hardware into the first component;
  - reassembling the second component, wherein reassembling the second component further comprises:
    - removing the second skyplate hardware resulting in the second removed hardware.

Aspect 21. A computer readable medium comprising:
- a processor;
- a memory; and
- a set of instructions which when executed are configured to enable the method comprising:
- disassembling of a component,
  - wherein disassembling further comprises removing a hardware from the first component;
- placing the removed hardware of the first component into a first skyplate corresponding to the first component;
- reassembling the first component,
- wherein reassembling the first component further comprises:
- removing the hardware from the first skyplate; and
  - replacing the removed hardware into the first component.

Aspect 22. The computer readable medium of Aspect 21, wherein the first component further comprises one or more parts.

Aspect 23. The computer readable medium of Aspect 21, wherein disassembling further comprises removing the one or more parts of the first component in a first sequential order or mechanically practical order.

Aspect 24. The computer readable medium of Aspect 23, wherein replacing the removed hardware further comprises replacing the removed hardware in a reversed sequential order or mechanically practical order.

Aspect 25. The computer readable medium of Aspect 24, wherein the reversed sequential order or mechanically practical order is a performance of the first sequential order or mechanically practical order in reverse.

Aspect 26. The computer readable medium of Aspect 21, wherein placing the removed hardware further comprises placing the removed hardware in the first skyplate in a second sequential order or mechanically practical order corresponding to the first sequential order or mechanically practical order of disassembling.

Aspect 27. The computer readable medium of Aspect 21, wherein the first component further comprises one of more of: a part, a tool, a vehicle, and an equipment.

V. Claims

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

The following is claimed:

1. An apparatus comprising:
- a substrate configured to house hardware units associated with an object, the object being configured to comprise the hardware units assembled therein; and
- a plurality of holes for housing at least a portion of hardware units associated with the object,
  - wherein the plurality of holes are configured within the substrate at a position relative to a shape of the substrate,
  - wherein the position relative to the shape of the substrate is based on the hardware units' assembled position relative to a shape of the object, and
  - wherein a layout of the plurality of holes within the substrate is proportionally smaller in size than a layout of the hardware units in their assembled position relative to the shape of the object.

2. The apparatus of claim 1, wherein the plurality of holes are configured to secure the at least one hardware unit to the substrate by at least one of the following: threads, fasteners, grommets, eyelets, locks, tightness of grip, and interlocking mechanisms.

3. The apparatus of claim 1, wherein the layout of the plurality of holes is configured to be one or more of:
- the plurality of holes in a spaced consistently with technical data configuration, and
- one or more holes grouped in a grouping configuration.

4. The apparatus of claim 3, wherein the spacing of a configuration determines a size of the substrate.

5. The apparatus of claim 1, wherein the layout of the plurality of holes further comprises an identifier wherein the identifier is one or more of: shapes, symbols, scripts, text, colors, numbers, braille, a schematic layout, a schematic shape, a technical specification, and markings.

6. The apparatus of claim 1, wherein the layout of the plurality of holes further comprises a mapping according to the object.

7. The apparatus of claim 6, wherein the mapping further comprises a first location of one of the plurality of holes on the substrate corresponding to a second location of the corresponding hardware unit configured to be assembled within the object.

8. The apparatus of claim 7, wherein the shape of the substrate is:

similar to the shape of the object; and is proportionally smaller than the object.

9. The apparatus of claim 1, wherein the shape of the substrate is one or more of: a rectangle, a triangle, a square, a circle, and an oval.

10. The apparatus of claim 1, wherein the apparatus is portable.

11. The apparatus of claim 1, wherein the apparatus is configured to be one or more of:

handheld;

affixed to another object;

affixed to another member; and affixed to wheels.

* * * * *